US008066204B2

(12) United States Patent
Petrovic et al.

(10) Patent No.: US 8,066,204 B2
(45) Date of Patent: Nov. 29, 2011

(54) SHOWER HEAD WITH INTEGRAL DIVERTER VALVE

(75) Inventors: John E. Petrovic, Hillsdale, MI (US); Peter Dabrowski, Macomb, MI (US); Curtis J. Bailey, Brimingham, MI (US); Michael A. Miller, Portage, MI (US)

(73) Assignee: Alsons Corporation, Hillsdale, MI (US)

( * ) Notice: Subject to any disclaimer, the term of this patent is extended or adjusted under 35 U.S.C. 154(b) by 855 days.

(21) Appl. No.: 11/359,647

(22) Filed: Feb. 22, 2006

(65) Prior Publication Data

US 2006/0138253 A1 Jun. 29, 2006

Related U.S. Application Data

(63) Continuation-in-part of application No. 11/311,828, filed on Dec. 19, 2005.

(60) Provisional application No. 60/637,373, filed on Dec. 17, 2004.

(51) Int. Cl.

| | |
|---|---|
| ***B05B 1/18*** | (2006.01) |
| ***B05B 15/08*** | (2006.01) |
| ***B05B 15/06*** | (2006.01) |
| ***B05B 1/30*** | (2006.01) |

(52) U.S. Cl. ..... 239/447; 239/443; 239/525; 239/581.2; 239/582.1; 239/587.4; 4/601; 4/605

(58) Field of Classification Search ..... 239/443, 239/525, 581.2, 582.1, 11, 282, 289, 391, 239/396, 436, 444, 446–449, 548, 556–559, 239/562, 581.1, 587.2–587.4; 4/601, 605, 4/604

See application file for complete search history.

(56) References Cited

U.S. PATENT DOCUMENTS

| | | | | |
|---|---|---|---|---|
| 769,429 | A | | 9/1904 | Caldwell |
| 1,081,688 | A | | 12/1913 | Mohl |
| 1,187,245 | A | | 6/1916 | Bjerke |
| 2,075,600 | A | | 3/1937 | Baker |
| 2,286,933 | A | * | 6/1942 | Royal ..... 239/446 |
| 2,313,631 | A | | 3/1943 | Downey |
| 2,354,582 | A | | 7/1944 | Downey |
| 2,441,253 | A | | 5/1948 | Sarver |
| 2,534,577 | A | | 12/1950 | Courtot |
| 2,891,732 | A | | 6/1959 | Orter et al. |
| 3,112,073 | A | | 11/1963 | Larson et al. |
| 3,403,700 | A | | 10/1968 | Meynell |
| 3,461,870 | A | * | 8/1969 | Van Linge ..... 604/118 |
| 3,471,872 | A | * | 10/1969 | Symmons ..... 4/570 |
| 3,731,905 | A | | 5/1973 | Piet |
| 3,810,580 | A | * | 5/1974 | Rauh ..... 239/460 |
| 3,967,783 | A | | 7/1976 | Halsted et al. |
| 4,203,551 | A | | 5/1980 | Levine |
| 4,311,279 | A | * | 1/1982 | Jette ..... 239/562 |
| 4,385,641 | A | | 5/1983 | Albertin et al. |
| 4,568,060 | A | | 2/1986 | Sud |
| 4,681,140 | A | | 7/1987 | Hayman |

(Continued)

*Primary Examiner* — Darren W Gorman

(74) *Attorney, Agent, or Firm* — Carlson, Gaskey & Olds, P.C.

(57) ABSTRACT

A shower assembly is provided that includes a shower head having an integrated diverter valve. The shower head receives a detachable hand-held shower wand. The diverter valve is arranged upstream of an adjustable connector so that length is not added to the shower assembly that would interfere with headroom. A cam shaft of the diverter valve is rotated to selectively control fluid flow between the shower head and the hand-held shower wand. Cam followers are moved linearly in response to rotation of the cam shaft to selectively block first and second outlet ports.

8 Claims, 8 Drawing Sheets

U.S. PATENT DOCUMENTS 4,752,975 A * 6/1988 Yates ..... 4/601
4,865,078 A 9/1989 Ensign
4,884,595 A 12/1989 Grove
4,901,927 A * 2/1990 Valdivia ..... 239/446
4,903,897 A 2/1990 Hayes
4,947,886 A 8/1990 Grove
4,991,569 A 2/1991 Martin
5,085,245 A 2/1992 Grove
5,160,093 A 11/1992 Battaglia
5,165,456 A 11/1992 Woolman
5,188,149 A 2/1993 Williams
5,230,106 A 7/1993 Henkin et al.
5,241,714 A 9/1993 Barry
5,310,162 A 5/1994 Baumann
5,441,080 A 8/1995 Baumann
5,713,850 A 2/1998 Heilmann et al.
5,788,160 A 8/1998 Woog
6,032,877 A 3/2000 Kagan
6,123,094 A 9/2000 Breda
6,227,456 B1 5/2001 Colman
6,230,989 B1 5/2001 Haverstraw et al.
6,454,186 B2 9/2002 Haverstraw et al.
6,618,872 B1 9/2003 Fan
6,708,726 B2 3/2004 Hashimoto
6,896,201 B1 * 5/2005 Ouyoung ..... 239/240
2002/0179164 A1 12/2002 Hashimoto
2003/0056287 A1 3/2003 Petrovic
2003/0121993 A1 7/2003 Haverstraw et al.
2003/0150495 A1 8/2003 Hara
2003/0208843 A1 11/2003 Schrag
2003/0226200 A1 12/2003 Charonis
2004/0124281 A1 7/2004 Leung
2005/0098661 A1 * 5/2005 Lev ..... 239/550

* cited by examiner

SHOWER HEAD WITH INTEGRAL DIVERTER VALVE

This application is a continuation-in-part of U.S. application Ser. No. 11/311,828, filed Dec. 19, 2005 which claims priority to U.S. Provisional Application No. 60/637,373 filed on Dec. 17, 2004.

BACKGROUND OF THE INVENTION

The present invention relates to a shower assembly and diverter valve for directing fluid from an inlet to multiple outlets. In particular, the invention relates to a rotatable diverter valve integrated with a shower head such as a fixed shower head.

Diverter valves typically used for shower assemblies include either a rotary or push-pull mechanism actuatable by the user. The push-pull diverter valves use longitudinal movable seal members to isolate between various flow paths. Such valves are not inherently intuitive to users.

Furthermore, the diverter valves have been installed upstream of the shower head between the shower spout that extends from the wall of the shower enclosure and the shower head. Such an arrangement not only detracts from the aesthetics of the shower assembly, but also adds length to the overall shower assembly creating headroom problems.

Typical rotary diverter valves utilize a seal that is mounted on a shaft rotatable about an axis to isolate the fluid paths. In particular, the seal is used to block one of two outlet ports. The seal can be arranged between the outlet ports so that fluid from the inlet exits both outlet ports. Rotating the shaft drags the seal across the sealing surface of the housing thereby wearing the seal. Over time, the worn seal does not sufficiently block the outlet ports thereby permitting leaks.

What is needed is a diverter valve that is intuitive to the user, has improved wear and does not create headroom problems.

SUMMARY OF THE INVENTION

The present invention provides a shower head that has an integrated diverter valve actuated by rotating a knob. The shower head does not add length to the shower assembly so that headroom is not reduced. Operation of the diverter valve is intuitive to a user.

The shower assembly includes a housing providing an inlet port and first and second outlet ports. The housing provides a shower head with nozzles that are fluidly connected to the second outlet port. A hand-held shower wand is fluidly connected to the first output port by a flexible line. The hand-held shower wand is removably supported by the housing for remote usage. A diverter valve is supported within the housing and is rotatable between multiple positions to selectively control fluid flow between the nozzles and the hand-held shower wand.

The housing includes a spray chamber that supports the diverter valve. A knob is connected to a cam shaft, which is arranged within the spray chamber. The knob is accessible from the exterior of the housing and is rotatable between multiple positions in an intuitive manner to control the fluid flow. The diverter valve is arranged upstream from a typical ball joint connection that secures the shower head to the spout extending from the shower wall enclosure.

Accordingly, the present invention provides a diverter valve that is intuitive to the user, has improved wear and does not create headroom problems.

These and other features of the present invention can be best understood from the following specification and drawings, the following of which is a brief description.

DETAILED DESCRIPTION OF THE PREFERRED EMBODIMENT

Figure 2A:
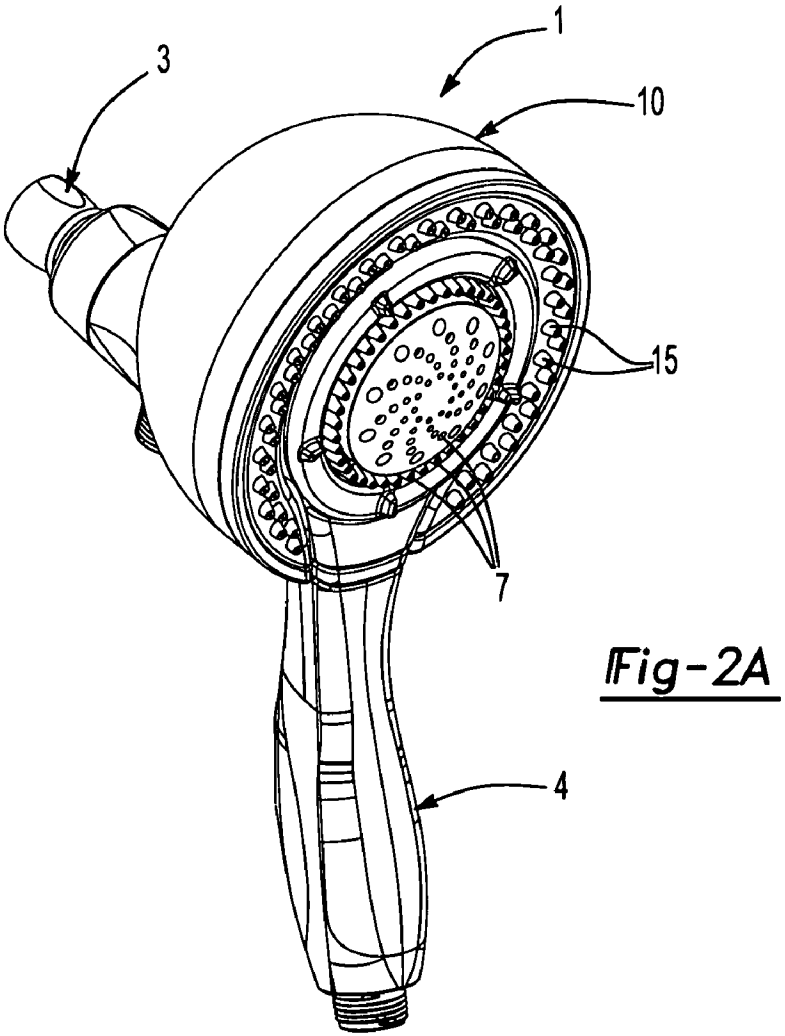
FIG. 2A is a perspective view of the shower assembly shown in FIG. 1.
Figure 1:
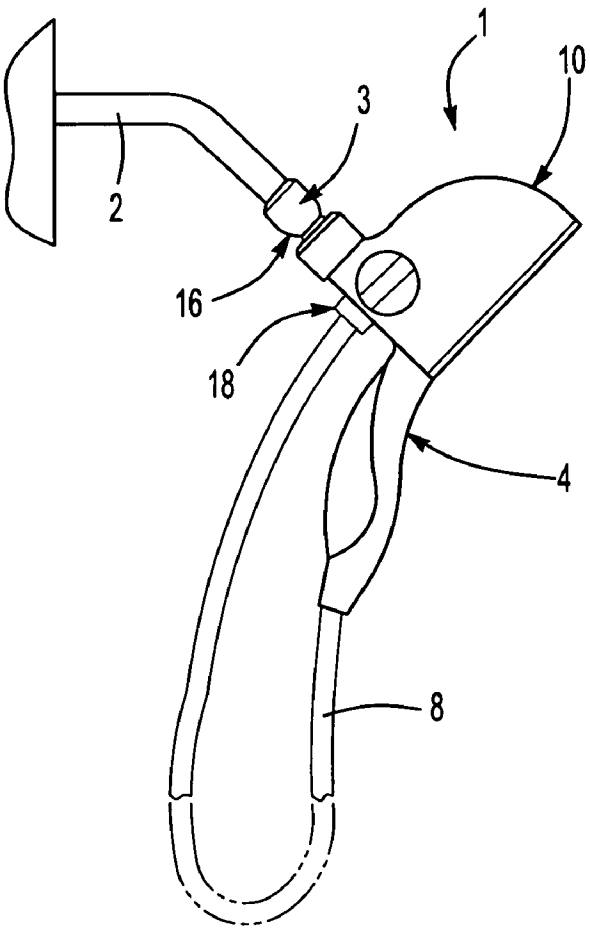
FIG. 1 is a side elevational view of the inventive shower assembly including a shower head and detachable hand-held shower wand.

A shower assembly 1 is shown in FIGS. 1 and 2A. The shower assembly 1 is removably attached to a spout 2 that extends from a wall of a shower enclosure using an adjustable connector 3. The adjustable connector 3 is typically a ball joint that permits a user to adjust the position of the shower assembly.

Figure 2B:
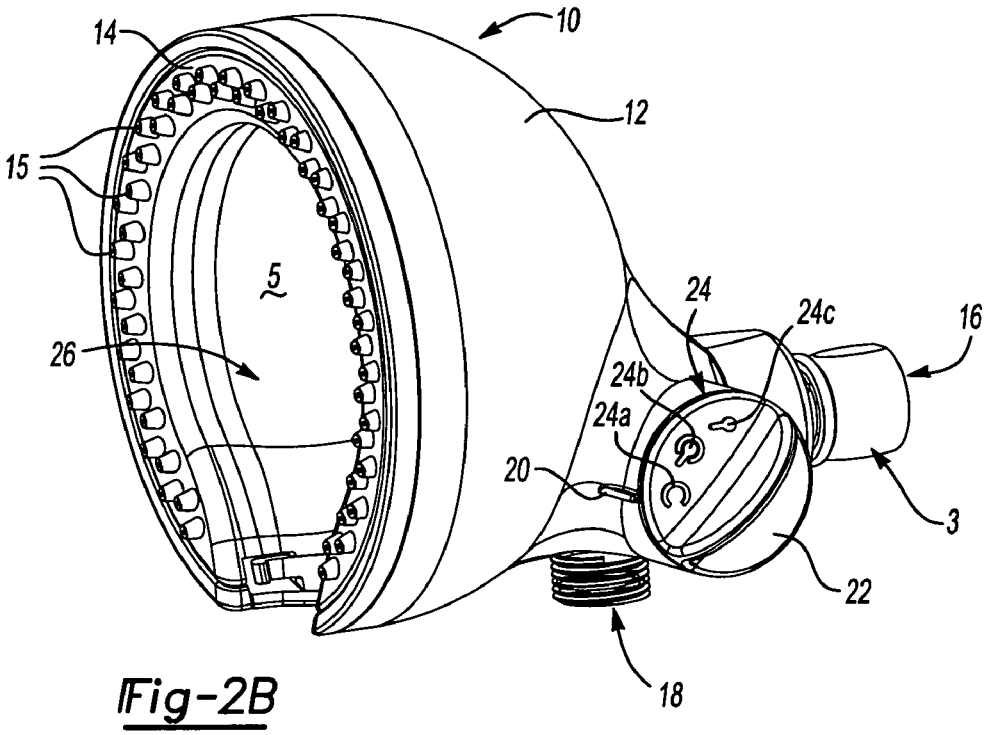
FIG. 2B is a side perspective view of a shower head incorporating the inventive diverter valve with the hand-held shower wand.

The shower assembly 1 includes a shower head 10 that provides nozzles 15. The shower head 10 includes a cavity 5 that removably receives a hand-held shower wand 4. The hand-held shower wand 4 is retained in the cavity 5 using clips 6, which is best shown in FIG. 2B. A fluid line 8, which is a flexible hose, fluidly connects an outlet port 18 on the shower head 10 to the hand-held shower wand 4. The hand-held shower wand 4 includes nozzles 7. The inventive diverter valve is integrated into the shower head 10 and is arranged upstream of the adjustable connector 3 to selectively control the fluid flow between the nozzle 7 and 15.

Figure 2C:
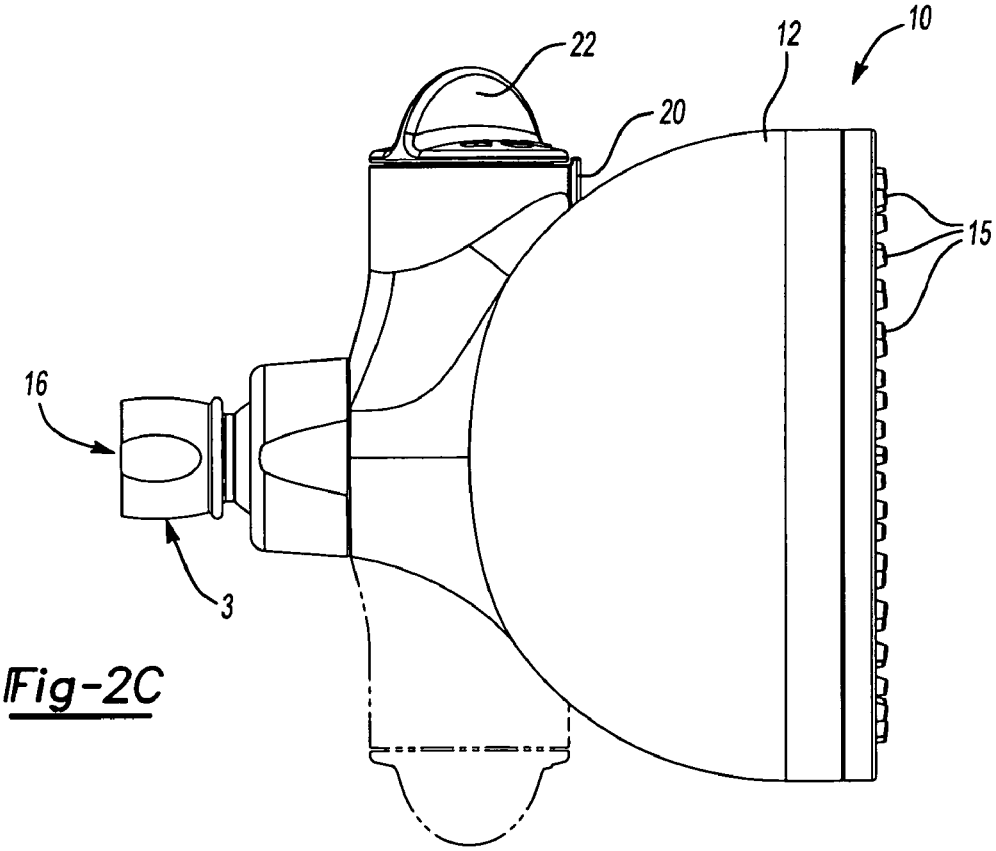
FIG. 2C is a top elevational valve of the shower head shown in FIG. 2B.
Figure 3:
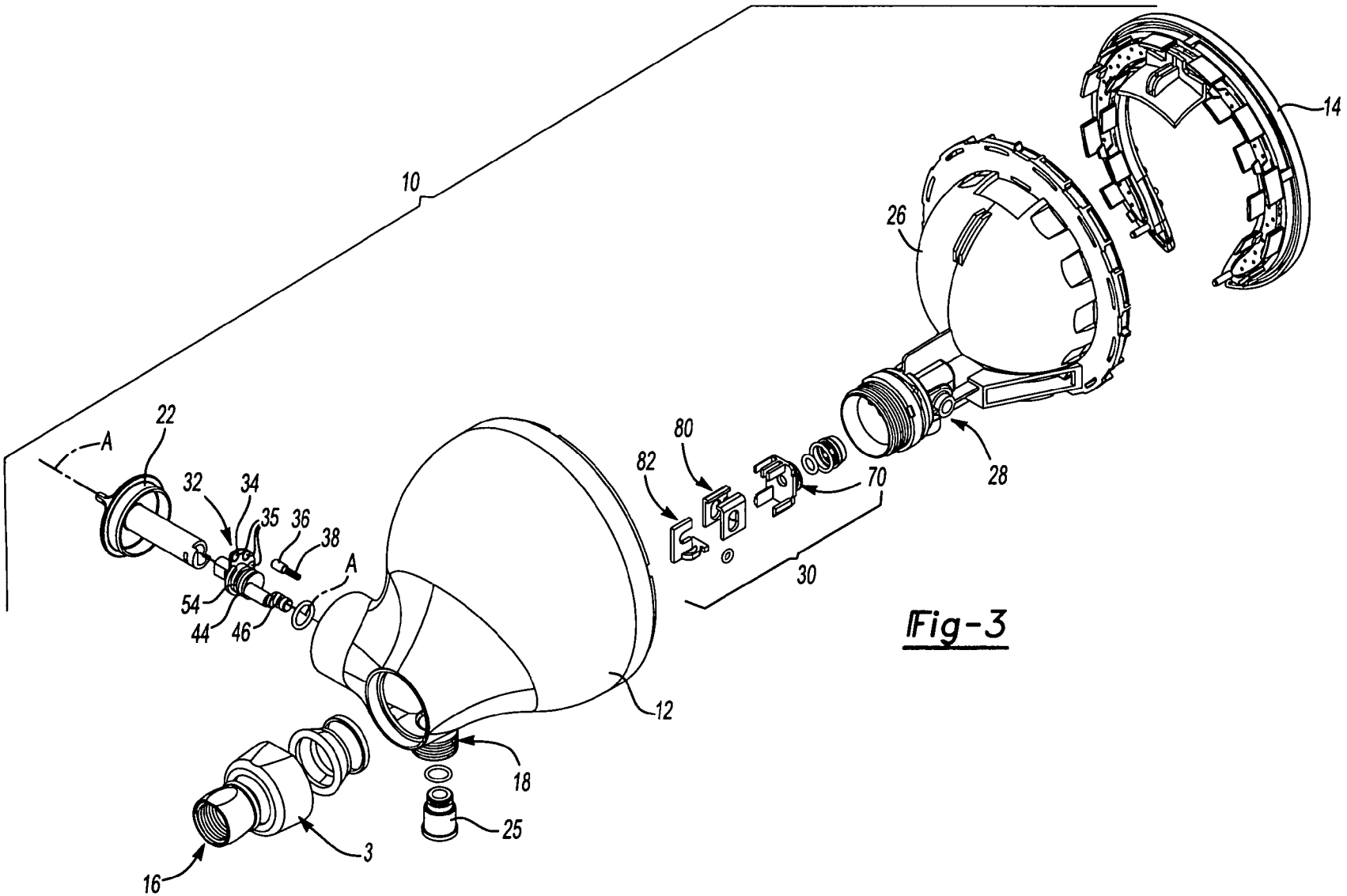
FIG. 3 is an exploded perspective view of the shower head shown in FIG. 1 including the inventive diverter valve.

The shower head 10 is shown in FIGS. 1-3 illustrating a diverter valve according to the present invention. The shower head 10 includes an outer housing 12 having a cover 14 providing the multiple spray nozzles 15. The cover 14 is secured to the outer housing 12. Water is provided to the shower head 10 by an inlet port 16. The outlet port 18 provides water from the inlet port 16, and may be used for a hand-held shower wand.

The diverter valve is actuated using an operating member or knob 22. The knob 22 can be arranged on either (or both) sides of the shower head 10. The knob 22 includes indicia 24 that are aligned with an indicator 20 in response to rotation of the knob 22. For example, an indicia 24*a* corresponds to water flow to the shower head only. An indicia 24*b* corresponds to water flow to both the shower head and the hand-held shower wand, and indicia 24*c* corresponds to water flow to the hand-held shower wand only.

In the example shown, the knob 22 is rotated between extreme positions in the 270 (9 o'clock) and 360 (12 o'clock) degree positions for a total of 90 degrees of rotation. The outlet ports are located in the 90 and 180 degree positions. When operating in this range and with the knob 22 rotated to align the indicia 24*b* with the indicator 20 to a midrange position of 315 degrees, the shower head and hand-held shower wand outlet ports are open 70% based upon the geometric relationship of the diverter valve components. By way of contrast, if the knob were to be rotated between positions other than 270-360 degrees to the other midrange positions (45, 135, and 225 degrees), for example, the outlets ports would only be open 30%.

Figure 3A:
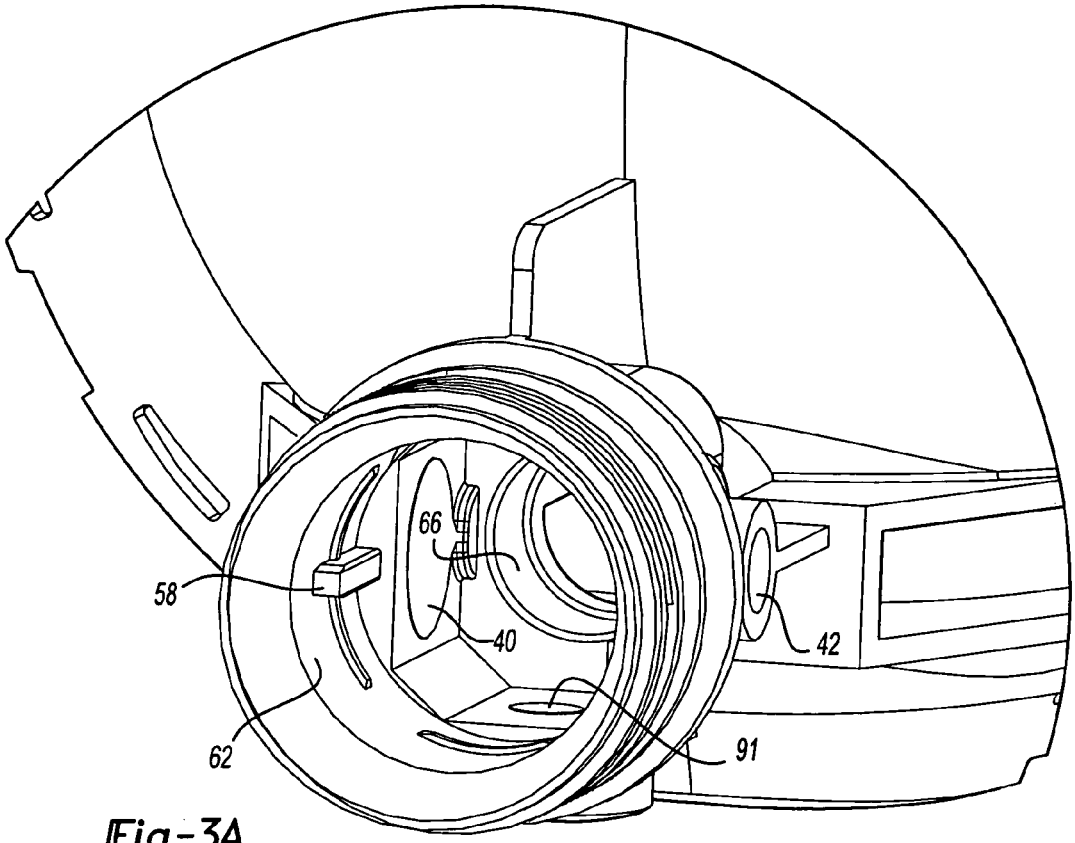
FIG. 3A is a perspective view of a valve body or housing supporting the inventive diverter valve.
Figure 3B:
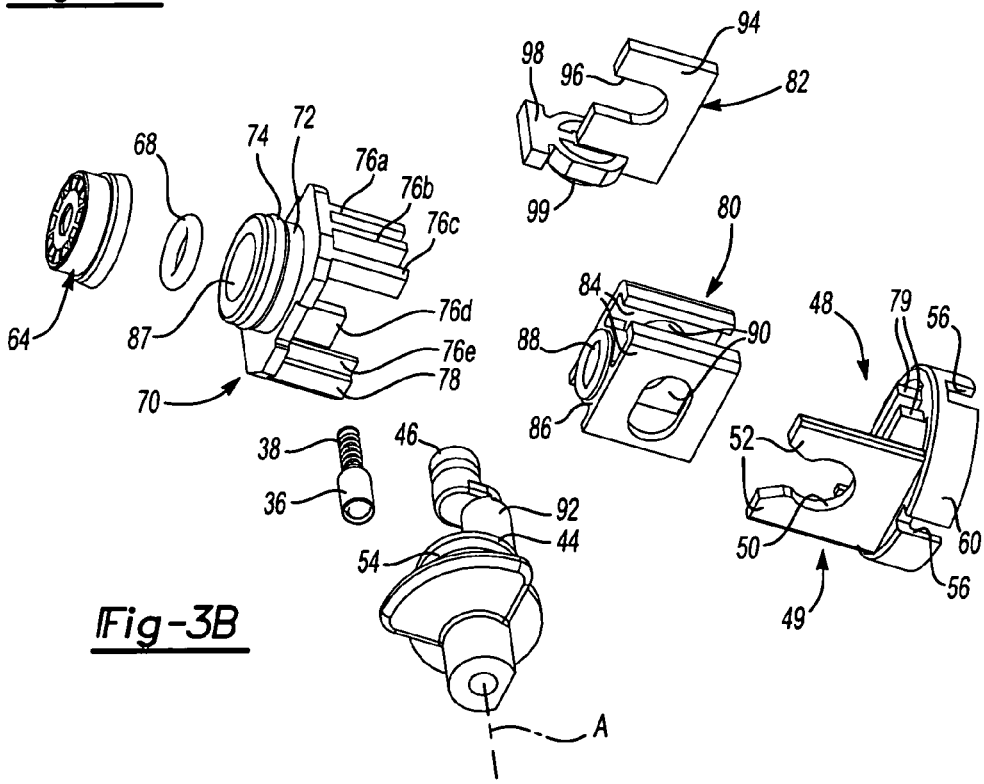
FIG. 3B is an enlarged exploded perspective view of the diverter valve.

Referring to FIGS. 3, 3A and 3B, the shower head 10 also includes an inner spray chamber 26 that provides a valve body or housing 28. A tube 25 extends between a threaded outlet connectors, which provides the outlet port 18, and the inner spray chamber 26. The tube 25 provides a seal relative to the outlet port 18 and the inner spray chamber 26.

The hole 66 (see FIG. 3A) provides another outlet port supplying water to the spray nozzles 15. The inventive diverter valve 30 is arranged within a cavity in the housing 28. The camshaft 32 is connected to the knob 22 and rotates about a rotational axis A. The camshaft 32 supports a plate 34 having multiple depressions 35 corresponding to the number of indicia 24. A detent 36 is biased by a spring 38 into engagement with the plate 34 and is seated in the depressions 35 when one of the indicia 24*a*, 24*b* and 24*c* is aligned with the indicator 20. The inner spray chamber 26 includes first and second holes 40 and 42 that receive large and small bearing surfaces 44 and 46 respectively of the camshaft 32.

Referring to FIG. 3B, a lock 48 includes a tab 49 having arms 52 providing an aperture 50. A recess 54 in the large bearing surface 44 receives the arms 52. The lock 48 is used to locate components of the diverter valve 30 within the housing 28. The lock 48 includes slots 56 that cooperate with protrusions 58 provided by the housing 28, which prevents rotation of the lock 48. The lock 48 also includes an outer surface 60 that is supported by a surface 62 in the housing 28.

A flow control regulator 64 is received in the hole 66 in the housing 28. A seal 68 is supported by the flow control regulator 64 and deforms under increasing pressure to restrict flow. A guide 70 is arranged in the cavity and includes an end 72 that supports a seal 74 that is received with in the hole 66. Multiple legs 76*a*, 76*b*, 76*c*, 76*d* and 76*e* extend longitudinally from the guide 70 toward the lock 48. First and second cam followers 80 and 82 are arranged between the guide 70 and the lock 48. In the example shown, the first cam follower 80 moves horizontally to selectively block an opening 87 in the guide 70, which is in fluid communication with a first outlet port providing fluid flow to the nozzles 15 via hole 66. The second cam follower 82 moves vertically to selectively block an opening 91, which is in fluid communication with a second outlet port that provides fluid flow to the hand-held shower wand.

The first cam follower 80 includes spaced apart members 84 that are arranged outside of the legs 76*a* and 76*b* and inside the legs 76*d* and 76*e*. The tab 49 is supported by a ledge 78 that is provided by the leg 76*e*, in the example shown. Locators 79 extending from the lock 48 are arranged between the spaced apart members 84. A blocking member 86 is supported by the spaced apart members 84 and includes a seal 88 that selectively engages the guide 70 to block fluid flow through the opening 87.

The first cam follower 80 includes elongated apertures 90 in the spaced apart members 84 that are supported on a cam lobe 92 of the camshaft 32. The elongated apertures 90 accommodate rotation of the cam lobe 92, which is offset relative to the rotational axis A so that the first cam follower 80 can move in a linear fashion along a longitudinal axis that corresponds with the opening 87, in the example shown.

The second cam follower 82 includes a guide member 94 having an elongated aperture provided by a slot 96. The slot 96 receives the cam lobe 92. The guide member 94 is slidingly received between the locators 79 and the legs 76*a* and 76*b*. The cam follower 82 moves linearly in a vertical fashion in response to rotation of the camshaft 32 corresponding to a longitudinal axis provided by the opening 91, in the example shown. The guide member 94 supports a blocking surface 98 having a seal 99 that engages a surface of the housing 28 around the opening 91.

The shower head 10 is assembled by inserting the inner spring chamber 26 into the outer housing 12 and securing the cover 14 to the outer housing 12. The guide 70 and first and second followers 80 and 82 (along with other components) are inserted into the valve body 28 provided by the inner spray chamber 26. The cam shaft 32 is inserted to the outer housing 12 through the first and second holes 40 and 42 of the valve body 28. The cam lobe 92 is received within the elongated apertures 90 and slot 96. The knob 22 is secured to the cam shaft 32.

Figure 4A:
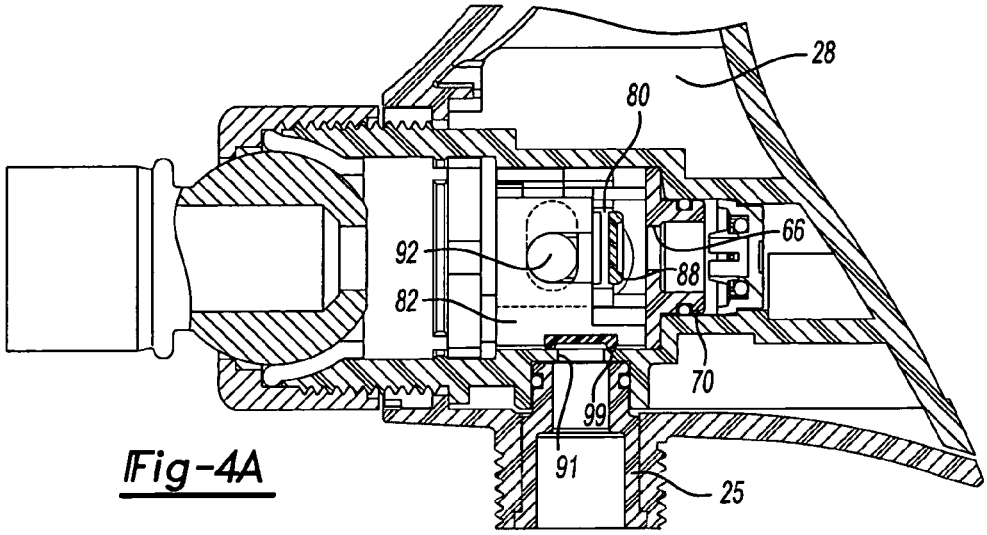
FIG. 4A is a cross-sectional view with the diverter valve in a position permitting flow to the shower head and blocking flow to the hand-held shower wand.

FIG. 4A depicts the position of the diverter valve 30 with the outlet port to the shower open and the outlet port to the hand-held shower wand blocked. Specifically, the first cam follower 80 is spaced from the opening 66, and the second cam follower 82 engages the sealing surface surrounding the opening 91.

Figure 4B:
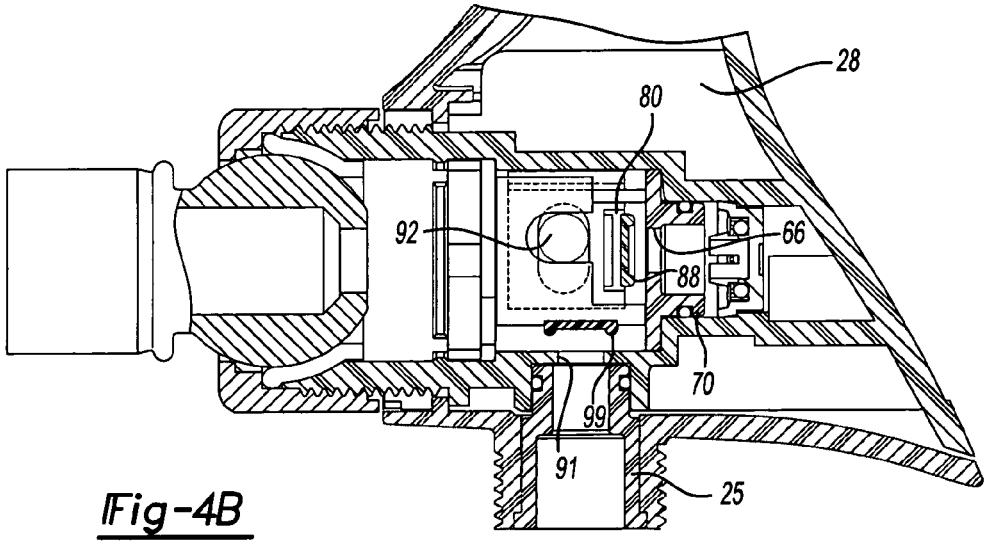
FIG. 4B is a cross-sectional view of the diverter valve in a position permitting flow to both the shower head and hand-held shower wand.

FIG. 4B depicts the diverter valve 30 in a position permitting fluid flow to both outlet ports. In this position, the first and second cam followers 80 and 82 are respectively spaced from the openings 66 and 91.

Figure 4C:
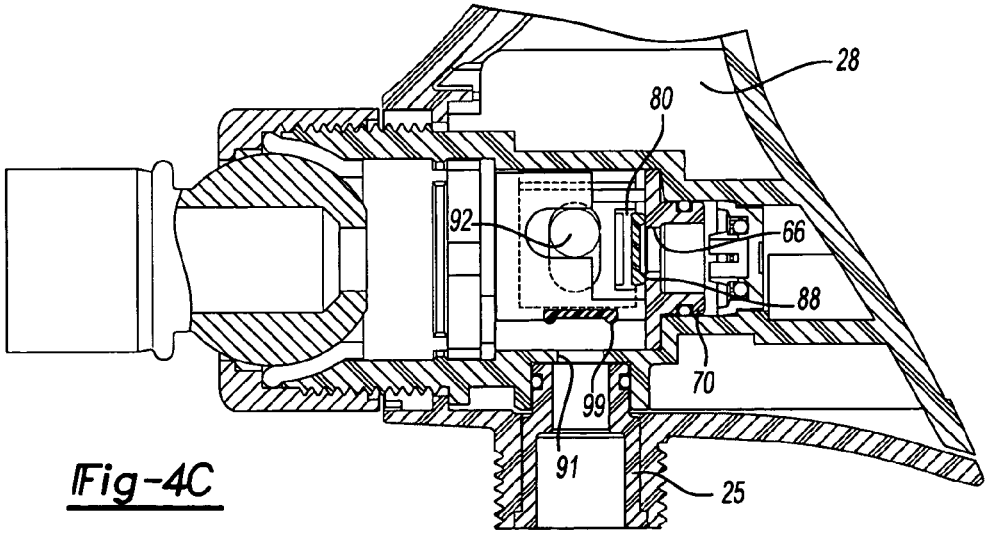
FIG. 4C is a cross-sectional view of the diverter valve in a position permitting flow to the hand-held shower wand and blocking flow to the shower head.
Figure 5:
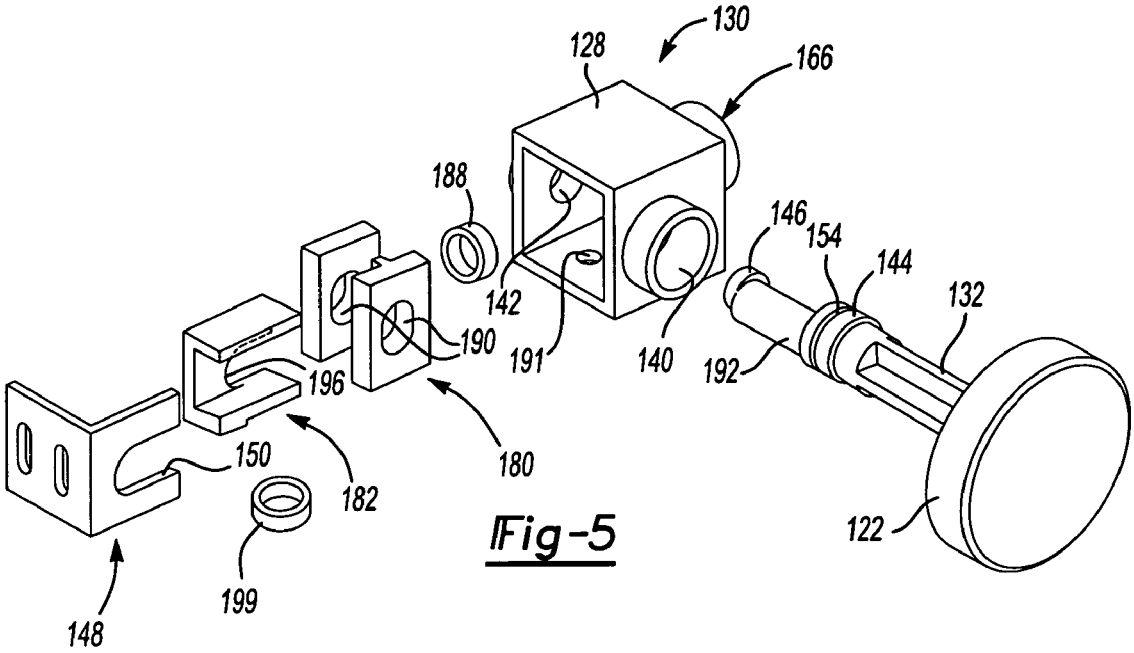
FIG. 5 is an exploded perspective view of another diverter valve.

FIG. 4C depicts the diverter valve 30 in a position blocking the outlet port to the shower and permitting fluid flow to the outlet port for the hand-held shower wand. The first cam follower 80 engages the sealing surface surrounding the opening 66, and the second cam follower 82 is spaced from the opening 91.

Figure 6A:
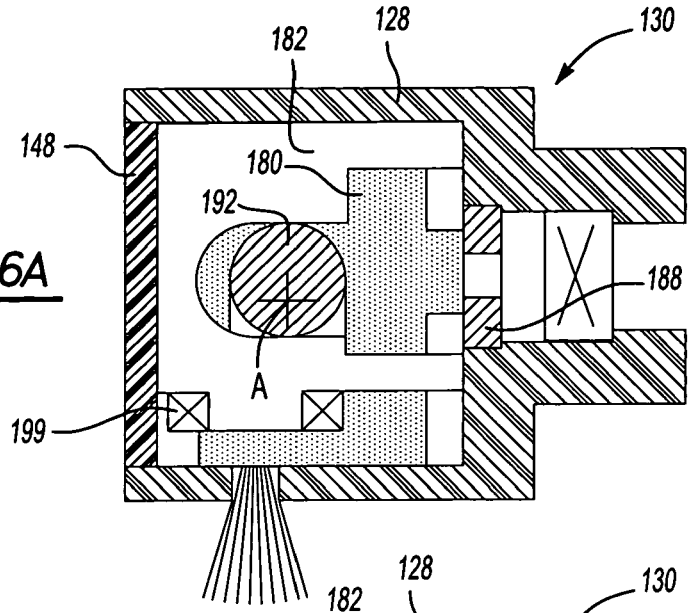
FIG. 6A is a cross-sectional view of the diverter valve shown in FIG. 5 blocking flow to a first outlet port and permitting flow to a second outlet port.
Figure 6B:
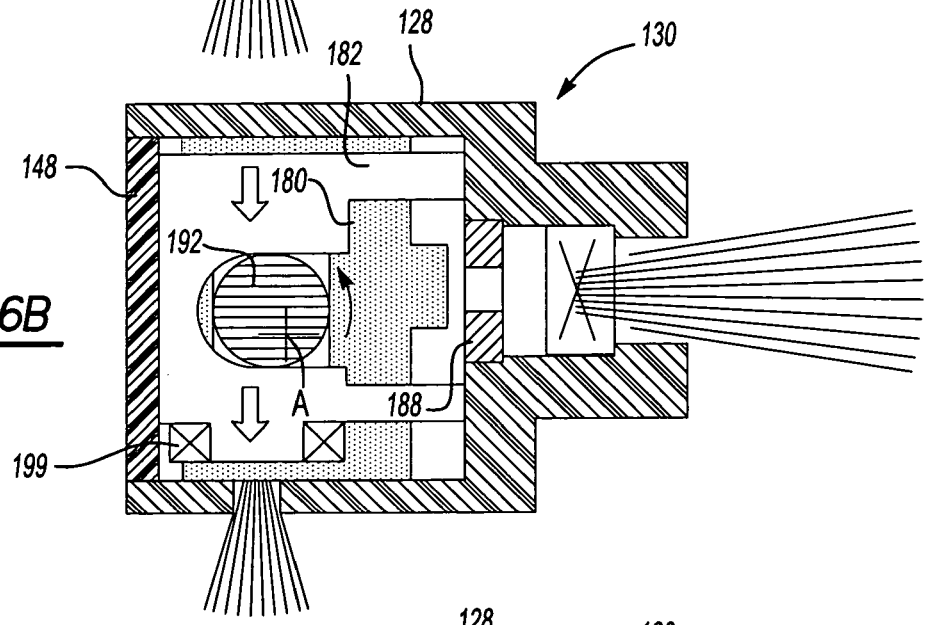
FIG. 6B is a cross-sectional view of the diverter valve shown in FIG. 5 in a position permitting fluid flow to both the first and second outlet ports.
Figure 6C:
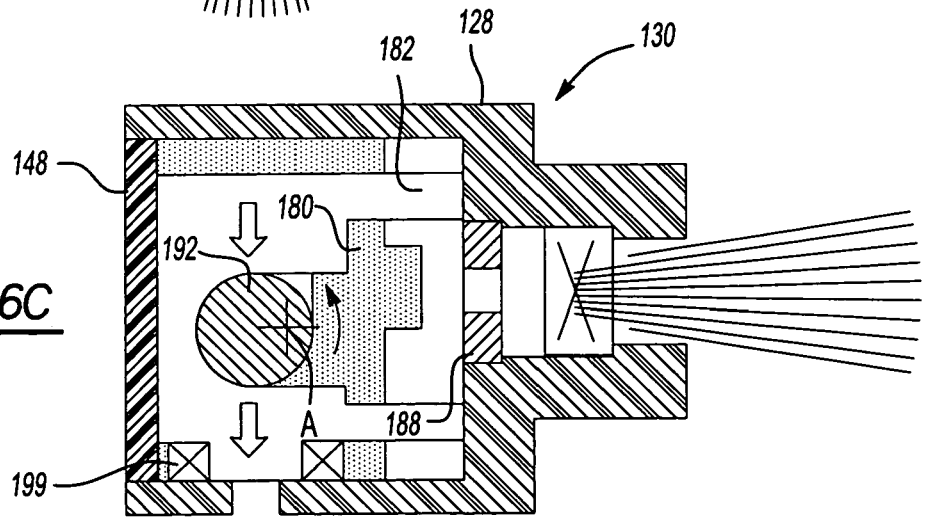
FIG. 6C is a cross-sectional view of the diverter valve shown in FIG. 5 in a position permitting fluid flow to the first outlet port and blocking flow to the second outlet port.

Another, stand alone diverter valve 130 is shown in FIG. 5 and FIGS. 6A-6C. Like numerals are used in the Figures for like elements previously discussed. FIG. 6A depicts the diverter valve 130 blocking flow to a first outlet port and permitting flow to a second outlet port. FIG. 6B depicts the diverter valve 130 in a position permitting fluid flow to both the first and second outlet ports. FIG. 6C depicts the diverter valve 130 in a position permitting fluid flow to the first outlet port and blocking flow to the second outlet port.

Figure 7:
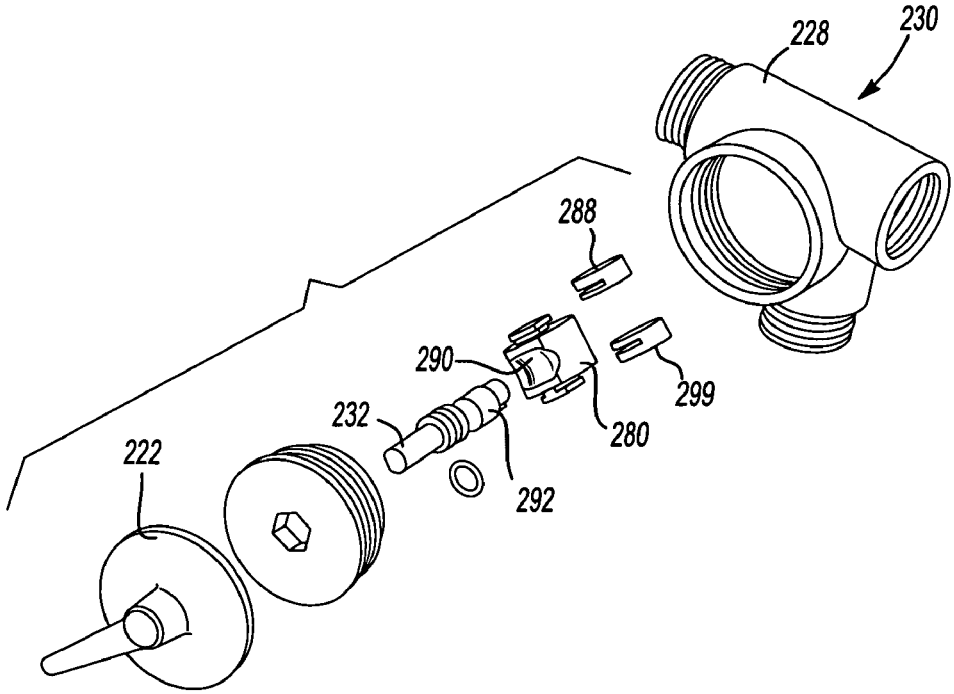
FIG. 7 is an exploded perspective view of another example diverter valve using a single cam follower.
Figure 8:
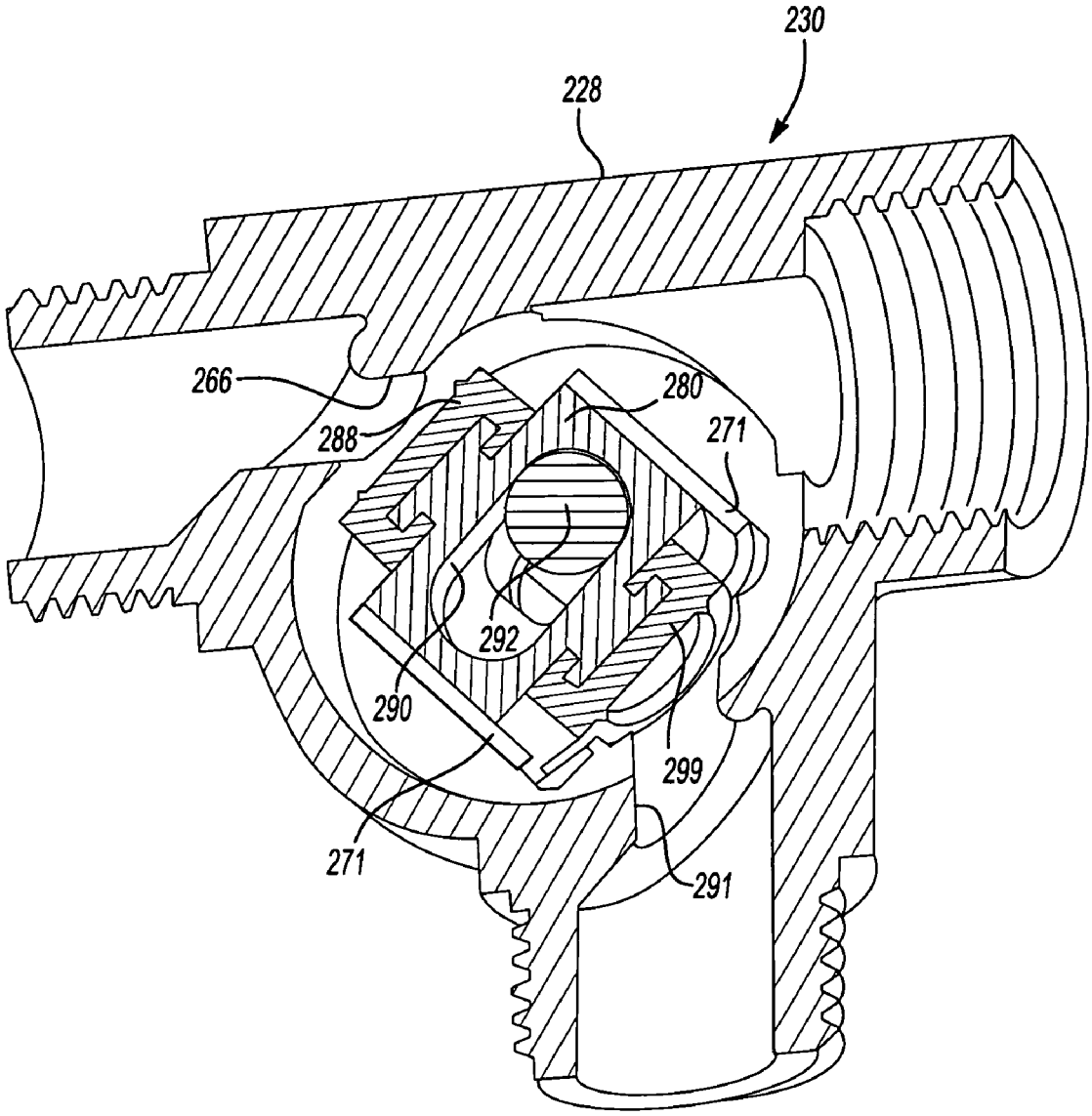
FIG. 8 is a cross-sectional view of the diverter valve in a position permitting fluid flow to the first and second outlet ports.

The embodiment shown in FIGS. 1-6C depict diverter valves with outlet ports arranged approximately 90 degrees or normal to one another. Another diverter valve 30 is shown in FIGS. 7 and 8. In this embodiment, a single cam follower 280 is used to selectively block outlet ports that are arranged approximately 180 degrees from one another. The cam follower 280 in FIG. 8 is shown with its seals 288 and 299 spaced from the openings 266 and 291 associated with the first and second outlet ports. The cam follower 280 slides against guides 271 in the housing 228. Like numerals are used in the Figures for like elements previously discussed.

Although a preferred embodiment of this invention has been disclosed, a worker of ordinary skill in this art would recognize that certain modifications would come within the scope of this invention. While the example embodiments only indicate one or two cam followers, the inventive diverter valve can use more than two followers to selectively control fluid flow through more than two outlet ports. The following claims should be studied to determine the true scope and content of this invention.

What is claimed is:

1. A shower assembly comprising:

a housing providing an inlet port and first and second outlet ports, the housing providing a shower head with nozzles fluidly connected to the second outlet port;

a hand-held shower wand fluidly connected to the first outlet part, the hand-held shower wand removably supported by the housing for use remote from the housing; and a diverter valve supported within the housing and rotatable between multiple positions to selectively control fluid flow from the inlet port to the first and second outlet ports, wherein the diverter valve includes a camshaft having an axis, cam lobe offset from the axis, and a cam follower supported on the cam lobe and movable along a longitudinal axis in response to rotation of the camshaft about the axis to selectively block at least one of the first and second outlet ports.

2. The shower assembly according to claim 1, wherein a knob is connected to the diverter valve, the knob rotating the diverter valve between first and second extreme rotational positions that are approximately ninety degrees from one another.

3. The shower assembly according to claim 2, wherein the first extreme rotational position prevents flow to the hand-held shower wand, and the second extreme rotational position prevents flow to the nozzles.

4. A method of using a shower assembly comprising the steps of:

a) securing a shower head to a spout, and prior to performing step a);

a1) .inserting an inner spray chamber into an outer housing:

a2) inserting a diverter valve into the inner spray chamber:

a3) inserting a camshaft into the inner spray chamber and outer housing subsequent to performing step a1);

b) providing a hand-held shower wand outlet port on the shower head; and c) rotating a knob on the shower head between multiple positions to control the flow of fluid to nozzles on the shower head and the hand-held shower wand port.

5. The method according to claim 4, wherein the knob is connected to the camshaft.

6. The method according to claim 4, wherein step a) is performed by providing a ball joint between the inner spray chamber and the spout.

7. The method according to claim 4, wherein step c) includes moving a cam follower in a linear direction in response to rotation of the knob.

8. The method according to claim 4, comprising the steps of:

b1) supporting a hand-held shower wand on the shower head; and b2) fluidly connecting the hand-held shower wand outlet port and the hand-held shower wand with a flexible fluid line.

* * * * *